US010367288B1

(12) United States Patent
Kato

(10) Patent No.: US 10,367,288 B1
(45) Date of Patent: Jul. 30, 2019

(54) ELECTRIC CONTACT AND CONNECTOR TERMINAL PAIR

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventor: Akihiro Kato, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/076,127

(22) PCT Filed: Feb. 16, 2017

(86) PCT No.: PCT/JP2017/005618
§ 371 (c)(1),
(2) Date: Aug. 7, 2018

(87) PCT Pub. No.: WO2017/154496
PCT Pub. Date: Sep. 14, 2017

(30) Foreign Application Priority Data

Mar. 8, 2016 (JP) ..... 2016-044296

(51) Int. Cl.
*H01R 13/03* (2006.01)
*C25D 7/00* (2006.01)
(Continued)

(52) U.S. Cl.
CPC ..... *H01R 13/03* (2013.01); *C25D 3/30* (2013.01); *C25D 3/46* (2013.01); *C25D 5/10* (2013.01);
(Continued)

(58) Field of Classification Search
CPC ..... H01R 13/03
See application file for complete search history.

(56) References Cited

U.S. PATENT DOCUMENTS 6,254,979 B1 * 7/2001 Drew ..... B32B 15/01 205/109
2003/0186597 A1 10/2003 Suzuki et al.
(Continued)

FOREIGN PATENT DOCUMENTS

JP H11-350188 A 12/1999
JP 2004-006065 A 1/2004
(Continued)

OTHER PUBLICATIONS

Mar. 28, 2017 International Search Report issued in International Patent Application No. PCT/JP2017/005618.

*Primary Examiner* — James Harvey
(74) *Attorney, Agent, or Firm* — Oliff PLC

(57) ABSTRACT

An electric contact that includes a first contact and a second contact that are capable of forming electrical contact with each other, wherein: the first contact has a silver-tin alloy layer exposed at an outermost surface that comes into contact with the second contact, the second contact has a silver layer exposed at an outermost surface that comes into contact with the first contact, and a surface roughness of the silver-tin alloy layer of the first contact is larger than a surface roughness of the silver layer of the second contact.

12 Claims, 4 Drawing Sheets

(51) Int. Cl.

| | |
|---|---|
| ***C25D 5/10*** | (2006.01) |
| ***H01R 13/11*** | (2006.01) |
| ***C25D 3/30*** | (2006.01) |
| ***C25D 3/46*** | (2006.01) |
| ***H01R 13/04*** | (2006.01) |
| ***C25D 5/50*** | (2006.01) |

(52) U.S. Cl.
CPC ..... *C25D 5/505* (2013.01); *C25D 7/00* (2013.01); *H01R 13/04* (2013.01); *H01R 13/11* (2013.01)

(56) References Cited

U.S. PATENT DOCUMENTS

2008/0090096 A1* 4/2008 Suzuki ..... C23C 2/28 428/674
2010/0266863 A1* 10/2010 Tanaka ..... C23C 18/165 428/555
2015/0037608 A1* 2/2015 Shinohara ..... H01R 13/03 428/673
2015/0236439 A1* 8/2015 Okubo ..... H01R 13/03 439/886
2016/0006153 A1 1/2016 Tsugawa et al.
2016/0276768 A1* 9/2016 Sunaga ..... C25D 7/00
2017/0033485 A1* 2/2017 Fukui ..... H01R 13/14
2018/0212350 A1* 7/2018 Tamura ..... C25D 7/00
2018/0316109 A1* 11/2018 Sunaga ..... C25D 5/10

FOREIGN PATENT DOCUMENTS

JP 2009-170416 A 7/2009
JP 2013-231228 A 11/2013
JP 2016-015224 A 1/2016
WO 2015/083547 A1 6/2015

* cited by examiner

ELECTRIC CONTACT AND CONNECTOR TERMINAL PAIR

This application is the U.S. National Phase of PCT/JP2017/005618 filed Feb. 16, 2017, which claims priority from JP 2016-044296 filed Mar. 8, 2016, the entire disclosure of which is incorporated herein by reference.

BACKGROUND

The present disclosure relates to an electric contact and a connector terminal pair, and more specifically relates to an electric contact having a coating layer containing silver as a main component on a surface of contact portions that come into electrical contact with each other, and a connector terminal pair having such an electric contact.

A silver plated terminal is sometimes used in an automobile as a connector terminal for large current. The silver plated terminal has excellent heat resistance, corrosion resistance, and electroconductivity, but silver is soft and thus the silver plated terminal has a property of tending to undergo adhesion, resulting in surface abrasion when the terminal is slid in and out. If the silver plating layer is partially removed due to abrasion and the metal of a lower layer such as a base material or a primer plating layer is exposed, the connection reliability of the terminal contact portion will decrease.

As one measure for suppressing abrasion at the time of sliding in the silver plated terminal, a surface of the silver plating layer is provided with an organic film in some cases. For example, in JP 2009-170416A, by providing the surface of an electric contact material made of noble metal such as silver with two organic films made of a specific organic compound, a reduction in the dynamic frictional coefficient of the surface and suppress abrasion is achieved.

Also, even in a case where a silver alloy layer is provided as a lower layer of the silver layer, suppression of abrasion on the surface of the silver layer can be achieved due to the effects of the composition and the organizational structure of the silver alloy layer while utilizing the high heat resistance, corrosion resistance, and electroconductivity of silver. For example, as disclosed in JP 2013-231228A filed by the present applicants, forming a layer structure in which the surface of a hard silver-tin alloy layer is coated with a soft silver coating layer of the electric contact of the connector terminal makes it possible to reduce the frictional coefficient of the electric contact. Abrasion of the silver can be suppressed by reducing the frictional coefficient.

Moreover, WO 2015/083547 filed by the present applicants discloses use of an embossed contact having a layer structure constituted by a silver-tin alloy layer and a silver coating layer as in JP 2013-231228A as an electric contact obtained by combing the embossed contact with a plate-shaped contact coated with a silver layer that does not have the silver-tin alloy layer directly below. Adopting such a combination makes it possible to reduce the frictional coefficient and to reduce the contact resistance of the surface when the electric contact undergoes abrasion.

SUMMARY

As disclosed in JP 2009-170416A, JP 2013-231228A and WO 2015/083547 above, reducing the (dynamic) frictional coefficient of the surface of the coating layer made of silver or a silver alloy is effective means for suppressing abrasion of the coating layer caused by sliding at the time of inserting and removing the terminal. However, if the frictional coefficient of the surface is reduced, another problem arises. That is, in a state in which a pair of terminals are fitted together, the pair of terminal contact portions tend to move relative to each other, and slight sliding tends to occur due to the influence of a slight force such as vibration. When this happens, there is a possibility that the connection reliability of the terminal pair will be impaired. Also, even though the terminal contact portion has a property of being inherently resistant to abrasion due to a low frictional coefficient, if slight sliding is repeated, there is a possibility that abrasion will advance.

An exemplary aspect of the disclosure provides an electric contact having a coating layer containing silver as a main component on a surface of contact portions that come into electrical contact with each other in which both a high frictional coefficient and suppression of abrasion are achievable, and to provide a connector terminal pair.

An electric contact according to the present disclosure is an electric contact including a first contact and a second contact that are capable of forming electrical contact with each other, in which the first contact has a silver-tin alloy layer exposed at an outermost surface that comes into contact with the second contact, and the second contact has a silver layer exposed at an outermost surface that comes into contact with the first contact.

Here, it is preferable that a surface roughness of the silver-tin alloy layer of the first contact is larger than a surface roughness of the silver layer. Also, it is preferable that the silver-tin alloy layer of the first contact has a surface roughness Ra of 0.5 μm or more and 2.0 μm or less.

It is preferable that the first contact has a silver layer directly below the silver-tin alloy layer.

It is preferable that the silver-tin alloy layer of the first contact has a hardness of 150 Hv or more. It is preferable that the silver layer of the second contact has a hardness of 50 Hv or more and 80 Hv or less.

It is preferable that at least one of the first contact and the second contact has a primer metal layer made of nickel or a nickel alloy between a base material and a layer that is exposed at the outermost surface.

It is preferable that the base material that forms the first contact and the second contact is made of any of copper, a copper alloy, aluminum, and an aluminum alloy.

It is preferable that the first contact is a contact having a bulge shape, and the second contact is a contact that has a plate shape and comes into electrical contact with an apex portion of the first contact.

A connector terminal pair according to the present disclosure includes a pair of connector terminals that come into electrical contact with each other at a contact portion, and the contact portion has the electric contact such as that described above.

In the electric contact according to the disclosure, the silver-tin alloy layer that has a high hardness and tends to have a rough surface structure is exposed at the outermost surface of the first contact, and the silver layer that has a low hardness and tends to have a smooth surface structure is exposed at the outermost surface of the second contact. As a result, in the electric contact therebetween, abrasion is unlikely to occur, and the frictional coefficient is large, suppressing the occurrence of unintended sliding caused by the influence of vibration and the like. Also, due to the fact that the silver layer is not disposed on the outermost surface of the first contact, it is possible to reduce the amount of silver used and cost required for the metal coating layer, compared to the case where the silver layer is formed on the outermost surfaces of both contacts as in WO 2015/083547 above.

Here, if the surface roughness of the silver-tin alloy layer of the first contact is larger than the surface roughness of the silver layer, it is possible to effectively obtain a high frictional coefficient in the electric contact due to a surface roughness of the silver-tin alloy.

If a surface roughness Ra of the silver-tin alloy layer of the first contact is 0.5 μm or more and 2.0 μm or less, a high frictional coefficient can be easily obtained in the electric contact. On the other hand, it is possible to avoid a situation that the connection reliability of the electric contact decreases due to an excessive surface roughness.

If the first contact has the silver layer directly below the silver-tin alloy layer, it is possible to increase the adherence between the surface of the base material or the primer metal layer and the silver-tin alloy layer.

If the hardness of the silver-tin alloy layer of the first contact is 150 Hv or more, it is possible to effectively suppress abrasion of the silver-tin alloy layer due to the high hardness.

If the hardness of the silver layer of the second contact is 50 Hv or more and 80 Hv or less, it is possible to effective increase the frictional coefficient of the electric contact. Also, abrasion of the silver-tin alloy layer of the first contact and the silver layer of the second contact is easier to suppress.

If at least one of the first contact and the second contact has the primer metal layer made of nickel or a nickel alloy between the base material and the layer that is exposed at the outermost surface, even if the electric contact is placed in a heated environment, it is possible to prevent diffusion of atoms constituting the base material, such as copper, to the outermost surface.

If the base material that constitutes the first contact and the second contact is made of any of copper, a copper alloy, aluminum, and an aluminum alloy, it is possible to provide the electric contact of the connector terminal made of these metals that are generally used as the terminal base material with properties of suppressing abrasion and a high frictional coefficient.

If the first contact is a bulge-shaped contact having a bulge shape, and the second contact is a plate-shaped contact that has a plate shape and comes into electrical contact with the apex portion of the bulge-shaped contact, it is possible to effectively suppress abrasion while ensuring a high frictional coefficient in the bulge-shaped contact in which abrasion is more likely to be a problem than the plate-shaped contact because the bulge-shaped contact always comes into contact with the plate-shaped contact in a region of the apex portion that has a small area.

The connector terminal pair according to the disclosure includes electric contacts in which the silver-tin alloy layer is exposed at the outermost surface of one of the contacts and the silver layer is exposed in the other contact. Accordingly, it is possible to achieve a high frictional coefficient and reduce unintended sliding while suppressing abrasion at the contact portion.

DETAILED DESCRIPTION OF EMBODIMENTS

Hereinafter, an embodiment of the present disclosure will be described in detail with reference to the drawings.

Electric Contact

An electric contact according to an embodiment of the present disclosure includes a pair of a first contact 10 and a second contact 20. The first contact 10 and the second contact 20 can come into electrical contact with each other on their surfaces.

Although the first contact 10 and the second contact 20 may have any shape, as one example, the first contact 10 may be configured as a bulge-shaped contact having a bulge shape such as an embossed shape. Also, the second contact 20 may be configured as a plate-shaped contact having a flat plate shape or the like. In this case, the first contact 10 configured as a bulge-shaped contact comes into electrical contact with a surface of the second contact 20 at an apex portion of the bulge shape. A combination of such contacts is often used for a male-female type fitting terminal as described later with reference to FIG. 2.

Figure 1A:
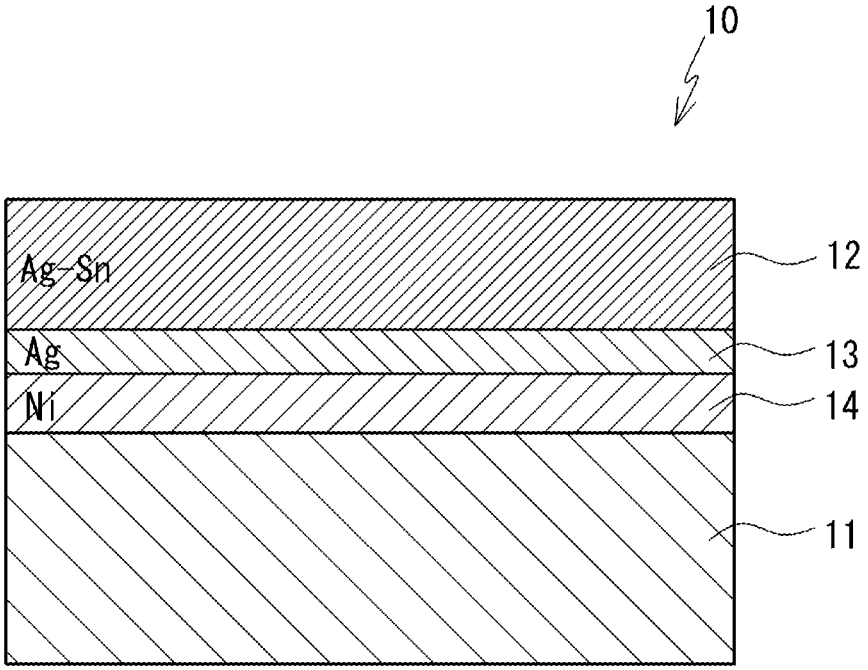
FIG. 1 is a cross-sectional view schematically showing two types of metal layer structures that constitute an electric contact according to an embodiment of the present disclosure, where (a) indicates a structure in which a silver-tin alloy layer of a first contact is exposed, and (b) indicates a structure in which a silver layer of a second contact is exposed.
Figure 1B:
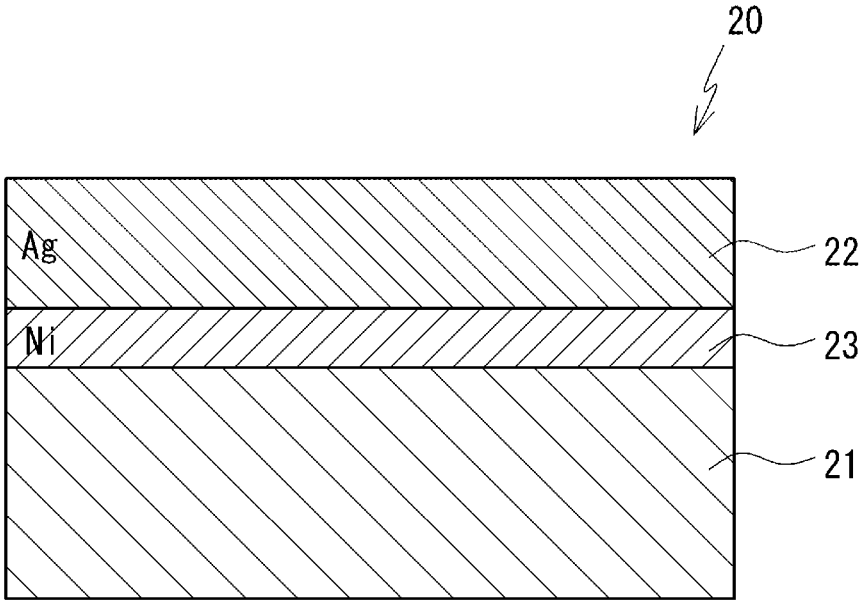

As shown in FIG. 1(*a*), a silver-tin alloy layer 12 is exposed at the outermost surface of the first contact 10. Moreover, as shown in FIG. 1(*b*), a silver layer 22 is exposed as the outermost surface of the second contact 20. The first contact 10 and the second contact 20 come into contact with each other respectively at the surfaces of the silver-tin alloy layer 12 and the silver layer 22.

In contact portions at which the first contact 10 in which the silver-tin alloy layer 12 is exposed and the second contact 20 in which the silver layer 22 is exposed come into contact with each other, it is possible to achieve a high abrasion resistance and a high frictional coefficient, unlike a case where the silver-tin alloy layer is exposed in both contacts or a case where the silver layer is exposed in both contacts. Hereinafter, detailed configurations of the first contact 10 and the second contact 20 will be described in order.

Configuration of First Contact

As shown in FIG. 1(*a*), in the first contact 10, the silver-tin alloy layer 12 is formed coating the surface of a base material 11. The silver-tin alloy layer 12 is exposed at the outermost surface of the first contact 10, and the first contact 10 comes into contact with the second contact 20 on the surface of the silver-tin alloy layer 12.

The silver-tin alloy layer 12 contains a silver-tin alloy as a main component, and more specifically, takes a phase having a $Ag_3Sn$ composition as a main phase. As will be described later, this silver-tin alloy layer 12 may be formed through an alloying reaction by heating a silver/tin layer structure in which a silver raw material layer and a tin raw material layer are layered one over another. Derived from this method, a residual silver layer 13 may be formed directly below the silver-tin alloy layer 12, that is, at a position on the side of the base material 11 that comes into contact with the silver-tin alloy layer 12, the residual silver layer 13 containing pure silver or a silver alloy having a higher silver ratio than the silver-tin alloy layer 12 as a main component. If the residual silver layer 13 is present, it is possible to increase the adherence between the base material 11 located below or the primer metal layer 14 and the silver-tin alloy layer 12.

The base material 11 is a base material of the first contact 10, and may be made of any metal material. It is preferable that the base material 11 is made of copper, a copper alloy, aluminum, or an aluminum alloy that is generally used as the base material of a connector terminal for an automobile. Alternatively, it is also preferable that the base material 11 is made of iron or an iron alloy.

A primer metal layer 14 may be formed as appropriate in contact with the base material 11 between the base material 11 and the silver-tin alloy layer 12 (and the residual silver layer 13). The primer metal layer 14 can play various roles such as increasing adherence between the base material 11 and the silver-tin alloy layer 12, and suppressing diffusion of elements constituting the base material 11. Examples of the primer metal layer 14 include a nickel (or a nickel alloy) layer and a pure copper layer. In particular, in the case where the base material 11 is made of copper or a copper alloy, if the primer metal layer 14 made of nickel or a nickel alloy is provided, diffusion of copper atoms from the base material 11 to the silver-tin alloy layer 12 is strongly prevented. In this case, the thickness of the primer metal layer 14 made of nickel or a nickel alloy is desirably in a range of 0.5 to 1.5 μm in order to sufficiently prevent copper atom diffusion. Also, in the case where the primer metal layer 14 made of nickel or a nickel alloy is formed and the residual silver layer 13 is present between the silver-tin alloy layer 12 and the primer metal layer 14, it is possible to achieve a high adherence between the primer metal layer 14 and the residual silver layer 13. On the other hand, in the case where the base material 11 is made of a copper alloy, if the primer metal layer 14 made of pure copper is formed on the surface of the base material 11, the adherence between the base material 11 and the silver-tin alloy layer 12 (and the residual silver layer 13) increases.

The silver-tin alloy layer 12 is made of an alloy having a very high hardness, and when the silver-tin alloy layer 12 is slid against the second contact 20, removal of the silver-tin alloy layer 12 is unlikely to occur due to its high hardness. In particular, from the viewpoint of highly suppressing abrasion, a Vickers hardness of the silver-tin alloy layer 12 is preferably 150 Hv, and more preferably 200 Hv or more.

From the viewpoint of realizing a high frictional coefficient between the silver-tin alloy layer 12 and the second contact 20, the silver-tin alloy layer 12 preferably has a larger surface roughness than the silver layer 22. The surface roughness of a metal layer depends on the size of metal crystal particles, and the larger the crystal particles are, the more the surface roughness tends to increase, and since the silver-tin alloy tends to produce crystal particles that are larger than that of pure silver, the silver-tin alloy layer 12 is likely to have a larger surface roughness than the silver layer 22. For example, from the viewpoint of achieving a sufficiently high frictional coefficient, an average arithmetic roughness Ra of the silver-tin alloy layer 12 is preferably 0.5 μm or more, and more preferably 1.0 μm or more. However, if the surface roughness is excessively large, it is difficult to form uniform electrical contact between the silver-tin alloy layer 12 and the silver layer 22 of the second contact 20, and thus Ra is preferably 2.0 μm or less.

The thickness of the silver-tin alloy layer 12 is preferably in a range of 1 to 45 μm. If the silver-tin alloy layer 12 is thin, the abrasion resistance decreases and there is a possibility that the connection reliability will be insufficient, and if the silver-tin alloy layer 12 is thick, there is a concern that the silver-tin alloy layer 12 will crack at the time of processing a terminal and the connection reliability will decrease due to exposure of the primer layer. Note that if the residual silver layer 13 is present, it is sufficient that the thickness including the thickness of the residual silver layer 13 is the thickness having the above-described range.

The silver-tin alloy layer 12 can be produced using a method similar to that for layer structures of the silver-tin alloy layer and the silver coating layer that are disclosed in JP 2013-231228A and WO 2015/083547. That is, it is sufficient that a silver raw material layer (e.g., pure silver layer) containing silver as a main component, and a tin raw material layer (e.g., pure tine layer) containing tin as a main component are respectively formed alternately, using electroplating or the like, and a silver/tin layer structure is produced. Then, the silver-tin alloy layer 12 can be obtained by heating the resulting silver/tin layer structure so as to cause alloying. Note that, in JP 2013-231228A and WO 2015/083547, from the viewpoint of forming the silver coating layer on the outermost surface, parameters such as the layer order of the silver/tin layer structure, the number of layers, and the thickness of the silver raw material layer and the tin raw material layer are defined, but it is necessary to select these parameters such that the silver-tin alloy layer 12 is exposed at the outermost surface.

For example, the tin raw material layer is used as the outermost surface layer of the silver/tin layer structure before heating, and thus a layer made of silver does not remain on the outermost surface after alloying, and the silver-tin alloy layer 12 is easily exposed. Alternatively, if the silver raw material layer is used as the outermost surface of the silver/tin layer structure, it is sufficient that the silver raw material layer on the outermost surface is formed thin, such as thinner than the tin raw material layer directly below, for example. Also, in order to form the residual silver layer 13 directly below the silver-tin alloy layer 12, it is sufficient that the silver raw material layer is used as the undermost layer of the silver/tin layer structure before heating. Among silver/tin layer structures capable of exposing the silver-tin alloy layer 12 at the outermost surface through heating and forming the residual silver layer 13 directly below, the lowest number of layers that constitute the silver/tin layer structure is achieved with the two-layer structure in which a silver raw material layer is formed on the surface of the base material 11 provided with the primer metal layer 14 as appropriate, and a tin raw material layer is then formed.

It is preferable that a heating temperature when the silver/tin layer 12 is formed by heating the silver/tin layer structure constituted by the tin raw material layer and the silver raw material layer is from about 180° C. to 300° C. It is sufficient that a heating time is set as appropriate such that the alloying reaction sufficiently advances at the selected heating temperature.

As described above, although the surface roughness of the silver-tin alloy layer 12 tends to influence the frictional coefficient between the silver-tin alloy layer 12 and the silver layer 22 of the second contact 20, the surface roughness of the silver-tin alloy layer 12 depends on the crystal particle diameter of a silver-tin alloy, and the crystal particle diameter depends on the temperature during alloying and the amounts of silver and tin. Utilization of a difference in the alloying speed due to the temperature during alloying and the amounts of silver and tin makes it possible to control the crystal particle diameter of the alloy and the surface roughness to some extent.

Configuration of Second Contact

As shown in FIG. 1(*b*), in the second contact 20, the silver layer 22 containing silver as a main component is formed so as to coat the surface of the base material 21 and to be exposed at the outermost surface.

The base material 21 is a base material of the second contact 20, and similarly to the base material 11 of the first contact 10, may be made of any metal material. Suitable examples thereof include the base material 21 being made of copper, a copper alloy, aluminum, or an aluminum alloy. Alternatively, the base material 21 may be made of iron or an iron alloy.

The silver layer 22 may contain not only pure silver but also other additive elements in a small amount as long as it is a metal layer containing silver as the main component. For example, a small amount of selenium, antimony, or the like may be added so as to increase the hardness as long as the added amount does not increase the resistance value by oxidation. The silver layer 22 is preferably formed by electroplating.

For the purpose of increasing the adherence between the base material 21 and the silver layer 22 and suppressing the diffusion of constituent elements of the base material 21, the primer metal layer 23 made of another type of metal may be formed as appropriate in contact with the base material 21 between the base material 21 and the silver layer 22. Examples of such a primer metal layer 23 include a nickel (or a nickel alloy) layer and a pure copper layer. In addition to these primer metal layers 23, layers of other types of metal may also be provided between the base material 21 and the silver layer 22, and it is preferable that a layer made of a silver-tin alloy is not provided at least directly below the silver layer 22 (a position at which the layer is in contact with the silver layer 22 on the side of the base material 21).

Silver is a metal having a low hardness, undergoes appropriate adhesion with the silver-tine alloy layer 12 of the first contact 10 due to softness of the silver layer 22, and can increase the frictional coefficient between the first contact 10 and the second contact 20. From the viewpoint of effectively increasing the frictional coefficient, the hardness of the silver layer 22 is preferably 100 Hv or less, and more preferably 80 Hv or less. However, if the hardness of the silver layer 22 is excessively low, abrasion of the silver layer 22 caused by excessive adhesion becomes a problem, and thus the hardness thereof is preferably 50 Hv or more.

The thickness of the silver layer 22 is preferably in a range of 1 to 45 μm. The reasons are as follows: if the silver layer 22 is thin, the silver layer 22 has a poor abrasion resistance and there is a concern that the connection reliability will become insufficient, and if the silver layer 22 is thick, there is a concern that the silver layer 22 will crack at the time of processing the terminal and the connection reliability will decrease due to the exposure of the primer layer.

Properties of Electric Contact

As described above, this electric contact includes the first contact 10 in which the silver-tin alloy layer 12 is exposed at the surface, and the second contact 20 in which the silver layer 22 is exposed at the surface. The silver-tin alloy layer 12 of the first contact 10 and the silver layer 22 of the second contact 20 come into contact with each other, and conduction is formed between both contacts 10 and 20.

Because the silver-tin alloy and silver have high melting points, the silver-tin alloy layer 12 and the silver layer 22 are thermally very stable, the first contact 10 and the second contact 20 can resist use at high temperatures. Also, silver tends not to oxidize, and the silver layer 22 is exposed at the surface of the second contact 20, which is one of the contacts that constitute the electric contact, and thus these contacts obtain lower contact resistance compared to a case where the silver-tin alloy layer is exposed at least in both contacts. Thus, the electric contact according to this embodiment can be preferably used in a site that easily reaches high temperatures, such as a connector terminal for large electric current or the like.

A combination in which the silver-tin alloy layer 12 is exposed at the surface of the first contact 10, and the silver layer 22 is exposed at the surface of the second contact 20 can suppress abrasion when the first contact 10 and the second contact 20 are slid against one another, and achieve a high frictional coefficient.

Abrasion is suppressed mainly by the effect of the high hardness of the silver-tin alloy layer 12 on the surface of the first contact 10. That is, at the first contact 10, the silver-tin alloy layer 12 has a high hardness, and thus removal of the silver-tine alloy by abrasion is unlikely to occur. In addition, despite that fact that the silver layer 22 that is soft and has a property of tending to undergo adhesion between the same kinds of metals is exposed in the second contact 20, the silver-tin alloy layer 12 that is hard and tends not to undergo adhesion is exposed at the surface of the first contact 10 against which the second contact 20 is slid, and thereby removal of the silver layer 22 by abrasion is also suppressed. In this manner, suppression of abrasion at the first contact 10 and the second contact 20 prevents exposure of the base materials 11 and 21 and the primer metal layers 14 and 23 during sliding. If the base materials 11 and 21 or the primer metal layers 14 and 23 are exposed, the electrical properties of the electric contacts vary or oxidation occurs on the surfaces, and thereby the connection reliability of the electric contacts is impaired.

On the other hand, a high frictional coefficient can be obtained by the effect of the silver layer 22 of the second contact 20 being smooth whereas the silver-tin alloy layer 12 of the first contact 10 has a large surface roughness. It is thought that a contact load concentrates on protruding portions of the surface roughness of the silver-tin alloy layer 12, and thus a high frictional coefficient can be obtained. Even if a force is applied by the influence of vibration or the like such that both contacts 10 and 20 move in a direction that intersects a direction in which the contacts 10 and 20 come into contact with each other, the first contact 10 and the second contact 20 are unlikely to move relative to each other due to a high frictional coefficient of the electric contact. If sliding by mutual movement is repeated, abrasion advances in the electric contact, and there is a risk that the connection reliability will be impaired. However, at the electric contact according to the present embodiment, even in a situation typified by an in-vehicle environment in which an external force such as vibration is easily received, abrasion on the surfaces of the contacts 10 and 20 can be highly suppressed by the effect of suppressing sliding due to the high frictional coefficient, in addition to the effect that abrasion is unlikely to occur due to the combination of the materials. Examples of a preferred embodiment include an embodiment in which a dynamic frictional coefficient between the first contact 10 and the second contact 20 is 0.4 or more, and an embodiment in which the dynamic frictional coefficient therebetween is 1.0 or more.

Although an embodiment was described above in which the first contact 10 in which the silver-tin alloy layer 12 is exposed is a bulge-shaped contact and the second contact 20 in which the silver layer 22 is exposed is a plate-shaped contact, even if a combination of the shapes of the first contact 10 and the second contact 20 is opposite, suppression of abrasion and a high frictional coefficient can be similarly achieved. However, if the bulge-shaped contact is slid against the surface of the plate-shaped contact, a contact position of the plate-shaped contact moves following sliding, whereas at the bulge-shaped contact, the apex of the bulge shape always serves as the contact point and thus tends to be influenced by abrasion. Therefore, from the viewpoint of effectively suppressing abrasion of the bulge-shaped contact, as described above, a mode in which the first contact 10 is the bulge-shaped contact is preferable.

Here, if the silver layer is exposed at the surfaces of both the first contact and the second contact, the silver layer tends not to oxidize, and thus an extremely low contact resistance is exhibited. However, the hardness of the silver layer is low and the silver layers tend to undergo adhesion, and thereby abrasion is very likely to occur during sliding. Although the frictional coefficient is high due to the low hardness and adhesiveness, as will be described later in working examples, the frictional coefficient is lower than in a case where the silver-tin alloy layer with a large surface roughness is one of the contacts. In this manner, suppression of abrasion and a high contact resistance are not achieved.

As disclosed in WO 2015/083547, in a case where the silver coating layer is formed on the surface of the silver-tin alloy layer of the first contact, and combined with the second contact in which the silver layer is exposed, so as to constitute an electric contact, layers made of silver are also exposed at the surfaces of both contacts. In this case, sliding also occurs between the layers made of silver, and thus a high frictional coefficient cannot be obtained to the extent in the case where the silver-tin alloy layer 12 is exposed at the outermost surface of the first contact 10 according to the embodiment of the present disclosure (see Tables 1 and 2 in WO 2015/083547). Also, although the primer metal layer or the base material is not exposed, removal of the layers made of silver on the outermost surfaces of both contacts occurs due to abrasion. Furthermore, in the case of this mode, because the silver coating layer is formed on the surface of the silver-tin alloy layer, use of silver increases for the electric contact as a whole, and a manufacturing cost required for a metal coating layer tends to increase. In the electric contact according to the above-described embodiment of the present disclosure, the silver coating layer is not formed on the surface of the silver-tin alloy layer 12, and thus the amount of silver used can be reduced and the manufacturing cost can be reduced.

On the other hand, if the silver-tin alloy layer is exposed at the surfaces of both the first contact and the second contact, the surfaces of both contacts have high hardnesses, and thus a high abrasion resistance can be obtained. However, a frictional coefficient becomes very small due to the high hardness. Therefore, suppression of abrasion and a high frictional coefficient are also not achieved in this case. Furthermore, the surface of the silver-tin alloy layer tends to oxidize, and the silver-tin alloy layer is exposed at the surfaces of both contacts, and thus as in the electric contact according to the above-described embodiment of the present disclosure, the contact resistance increases, compared to the case where the silver layer that tends not to oxidize is exposed in one of the contacts.

Connector Terminal Pair

Figure 2:
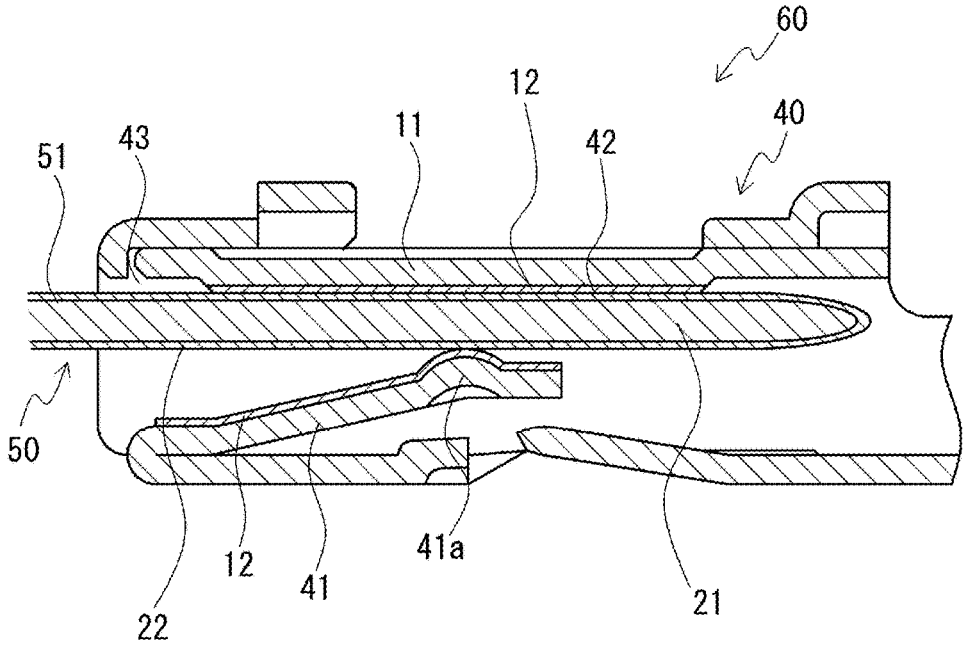
FIG. 2 is a cross-sectional view schematically showing a connector terminal pair according to an embodiment of the present disclosure.

A connector terminal pair according to an embodiment of the present disclosure may have any overall shape as long as the pair has the electric contact including the first contact 10 in which the silver-tin alloy layer 12 is exposed and the second contact 20 in which the silver layer 22 is exposed. As shown in FIG. 2, as one example, a connector terminal pair 60 according to an embodiment of the present disclosure is fittable and includes a combination of a female-type connector terminal 40 and a male-type connector terminal 50. Contact portions at which the female-type connector terminal 40 and the male-type connector terminal 50 come into electrical contact with each other have the above-described electric contact. Specifically, the silver-tin alloy layer 12 is exposed at the surface of the contact portion of the female-type connector terminal 40, and the silver layer 22 is exposed at the surface of the contact portion of the male-type connector terminal 50.

The female-type connector terminal 40 and the male-type connector terminal 50 have shapes similar to those of a known female-type connector terminal and a known male-type connector terminal. That is, a pressing portion 43 of the female-type connector terminal 40 is formed into a square tube shape with a forward opening, and has an elastic contacting piece 41 having a shape in which the contact piece is folded inwardly to the rear inside the bottom surface of the pressing portion 43. On the other hand, the male-type connector terminal 50 has, on its front end, a tab 51 formed into a flat plate. When the tab 51 of the male-type connector terminal 50 is inserted into the pressing portion 43 of the female-type connector terminal 40, the elastic contacting piece 41 of the female-type connector terminal 40 comes into contact with the male-type connector terminal 50 at an embossed portion 41*a* that bulges inward into the pressing portion 43, and applies an upward force to the male-type connector terminal 50. The surface of a ceiling portion of the pressing portion 43 that faces the elastic contacting piece 41 serves as an inwardly facing contacting face 42, and the male-type connector terminal 50 is pressed and held inside the pressing portion 43 by the male-type connector terminal 50 being pressed against the inwardly facing contacting face 42 by the elastic contacting piece 41. That is, the electric contact is formed between the surface of the tab 51 of the male-type connector terminal and the embossed portion 41*a* and the inwardly facing contact surface 42 of the female-type connector terminal 40.

Here, as shown in FIG. 2, the silver-tin alloy layer 12 (and the silver coating layer 13 and the primer metal layer 14, which are not shown) is formed at least on the surfaces of the embossed portion 41*a* of the elastic contacting piece 41 and the inwardly facing contact surface 42 of the base material 11 that forms the female-type connector terminal 40. The silver layer 22 (and the primer metal layer 23, which is not shown) is formed on at least the face of the tab 51 that comes into contact with the embossed portion 41*a* and the inner facing contact face 42, the face being part of the surface of the base material 21 that forms the male-type connector terminal 50. That is, the electric contact according to the embodiment of the present disclosure is formed between the embossed portion 41*a* and the inner facing contact face 42 of the female-type connector terminal 40 and the surface of the tab 51 of the male-type connector terminal.

Accordingly, when the tab 51 of the male-type connector terminal 50 is slid and inserted into the pressing portion 43 of the female-type connector terminal 40, abrasion is suppressed in the contact portion between the female-type connector terminal 40 and the terminal tab 51 of the male-type connector terminal 50. Moreover, even though a force is applied to the contact portion between the female-type connector terminal 40 and the male-type connector terminal 50 in a fitted state in a direction along the face of the terminal tab 51 and the inner facing contact face 42 by vibration of a vehicle provided with the connector terminal pair 60, the electric contact is unlikely to slide slightly, due to the effect of the high frictional coefficient.

Note that the silver-tin alloy layer 12 and the silver layer 22 may be formed over larger regions of the connector terminals 40 and 50. In the case of the largest region, the entire surfaces of the base materials 11 and 21 that constitute both connector terminals 40 and 50 may be coated. Also, the connector terminal pair may have any mode and shape, and another example thereof is a combination of a through hole formed in a printed wiring board and a press-fit terminal that is press-fitted into the through hole.

Working Examples

Hereinafter, the present disclosure will be described in detail by way of working examples.

Production of Test Pieces

Silver-Tin Alloy Exposed Test Piece

A nickel primer layer having a thickness of 1 μm was formed on a surface of a clean copper substrate by electroplating. On this surface, a soft silver layer (3 μm in thickness) serving as a silver raw material layer and a tin layer (2 μm in thickness) serving as a tin raw material layer were formed one at a time in this order by electroplating. These materials were heated for 90 minutes at 210° C. in the atmosphere. A test piece having a surface at which the silver-tin alloy layer was exposed (silver-tin alloy exposed test piece) was obtained in this manner.

Silver Exposed Test Piece

A nickel primer layer having a thickness of 1 μm was formed on a surface of a clean copper substrate by electroplating. A soft silver layer having a thickness of 5 μm was formed on this surface by electroplating. A test piece having a surface at which the silver layer was exposed (silver exposed test piece) was obtained in this manner.

Production of Electric Contact

Working Example 1

The silver exposed test piece obtained above was used as a plate-shaped contact. Also, the silver-tin alloy exposed test piece was processed into an embossed shape having a radius of curvature of 3 mm, and the resulting test piece was used as an embossed contact.

Working Example 2

The silver-tin alloy exposed test piece was used as a plate-shaped contact. Also, the silver exposed test piece was processed into an embossed shape that was similar to that of Working Example 1, and the resulting test piece was used as an embossed contact.

Comparative Example 1

The silver exposed test piece was used as a plate-shaped contact. Also, another silver exposed test piece was processed into an embossed shape that was similar to that of Working Example 1, and the resulting test piece was used as an embossed contact.

Comparative Example 2

The silver-tin alloy exposed test piece was used as a plate-shaped contact. Also, another silver-tin alloy exposed test piece was processed into an embossed shape that was similar to that of Working Example 1, and the resulting test piece was used as an embossed contact.

Testing Method

Evaluation of Surface States of Test Pieces

The Vickers hardnesses of the surfaces of the silver-tin alloy exposed test pieces and the silver exposed test pieces were measured using a Vickers hardness meter. The test load was 10 mN.

Also, the surfaces of the silver-tin alloy exposed test pieces and the silver exposed test pieces were observed through confocal measurement using a three-dimensional laser microscope ("OPTELICS H1200" manufactured by Lasertec). Moreover, the surface roughness was evaluated based on the observed images in terms of an average arithmetic roughness Ra.

Evaluation of Contact Resistance

The contact resistances of the electric contacts according to the working examples and the comparative examples were measured by bringing the embossed contacts into contact with the plate-shaped contacts while applying a contact load of 5 N. Measurement was performed by a four-terminal method. Also, the open-circuit voltage was set to 100 mV and the flowing current was set to 10 mA.

Evaluation of Abrasion Resistance

With regard to the electric contacts according to the working examples and the comparative examples, the embossed contacts were slid at a speed of 10 mm/min along the surfaces of the plate-shaped contacts in a state in which the embossed contacts were brought into contact with the plate-shaped contacts while applying a contact load of 5 N. Sliding was performed for 25 round trips over a 7 mm distance. After being slid, the surfaces of the embossed contacts were observed with a scanning electron microscope (SEM), and the states of abrasion of the outermost layers were checked. A case where exposure of the primer layer, that is, the primer metal layer made of nickel, or the copper base material was not observed was evaluated as having a good abrasion resistance "○", and a case where exposure of the primer layer was observed was evaluated as having insufficient abrasion resistance "x".

Evaluation of Frictional Coefficient

With regard to the electric contacts according to Working Example 1 and Comparative Examples 1 and 2, the embossed contacts were slid at a speed of 10 mm/min along the surfaces of the plate-shaped contacts in a state in which the embossed contacts were brought into contact with the plate-shaped contacts while applying a contact load of 5 N. A dynamic friction force acting between the contacts was measured using a load cell during this sliding. Then, a value obtained by dividing the dynamic friction force by the load was used as the (dynamic) frictional coefficient. Note that measurement was not performed on Working Example 2.

Test Results

Surface States of Test Pieces

Table 1 below shows the values of the hardness and surface roughness measured for the silver-tin alloy exposed test pieces and the silver exposed test pieces. Also, FIGS. 3(*a*) and 3(*b*) show three-dimensional microscopic images.

TABLE 1

| | Hardness (Hv) | Surface roughness Ra (μm) |
|---|---|---|
| Ag•Sn alloy exposed | 200 | 1.19 |
| Ag exposed | 60 | 0.31 |

Figure 3A:
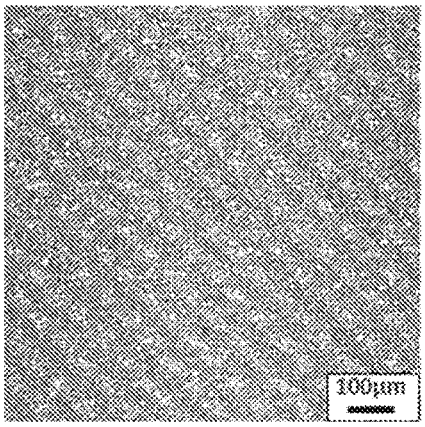
FIG. 3 is a surface photograph obtained using a three-dimensional laser microscope, where (a) indicates a silver-tin alloy layer and (b) indicates a silver layer.
Figure 3B:
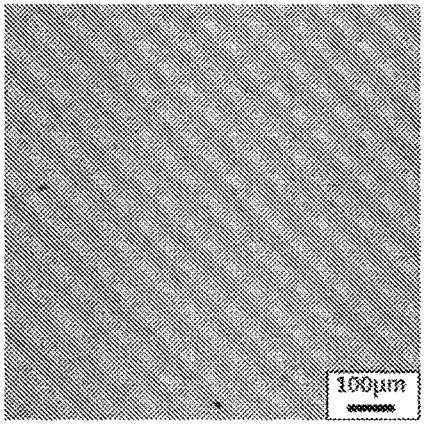

As shown in Table 1, the silver exposed test piece exhibits a low hardness of 60 Hv, whereas the silver-tin alloy exposed test piece exhibits a high hardness of 200 Hv. Also, as shown in FIG. 3 and Table 1, the silver exposed test piece has a surface with a high smoothness, whereas the silver-tin alloy exposed test piece is provided with an unevenness structure at intervals in the order of several micrometers to several tens of micrometers, and has a surface roughness Ra exceeding 1.0 μm.

Properties of Electric Contact

Table 2 list the results of evaluating the contact resistance, abrasion resistance, and (dynamic) frictional coefficient of each electric contact. Also, FIGS. 4(*a*) and 4(*b*) show SEM images of the surfaces of the embossed contacts obtained in the evaluation of abrasion resistance of Working Example 1 and Comparative Example 1.

TABLE 2

| | Metal layer | | | | |
|---|---|---|---|---|---|
| | plate-shaped contact | embossed contact | Contact resistance | Abrasion resistance | Frictional coefficient |
| Work. Ex. 1 | Ag | Ag•Sn alloy | 1.1 mΩ | ○ (primer layer not exposed) | 1.2 |
| Work. Ex. 2 | Ag•Sn alloy | Ag | 1.2 mΩ | ○ (primer layer not exposed) | — |
| Comp. Ex. 1 | Ag | Ag | 0.3 mΩ | x (primer layer exposed) | 0.9 |
| Comp. Ex. 2 | Ag•Sn alloy | Ag•Sn alloy | >1.5 mΩ | ○ (primer layer not exposed) | 0.3 |

According to Table 2, if the silver layers are exposed in both contacts of Comparative Example 1, the contact resistance exhibits a very low value due to the fact that the surface of the silver-tin alloy oxidizes relatively easily, whereas the surface of silver tends not to oxidize. Although having a larger contact resistance than that of Comparative Example 1, Working Examples 1 and 2 in which the silver-tin alloy is exposed in one of the contacts have a lower contact resistance than that of Comparative Example 2 in which the silver-tin alloy is exposed in both contacts.

Figure 4A:
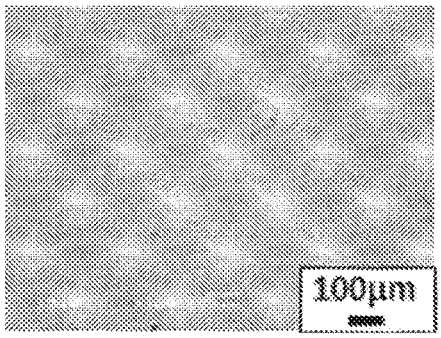
FIG. 4 shows an electron microscope (SEM) image obtained by observing a surface of an embossed contact after sliding in abrasion resistance evaluation, where (a) indicates the result of Working Example 1 (plate-shaped contact: Ag, embossed contact: Ag—Sn alloy) and (b) indicates the result of Comparative Example 1 (plate-shaped contact: Ag, embossed contact: Ag).
Figure 4B:
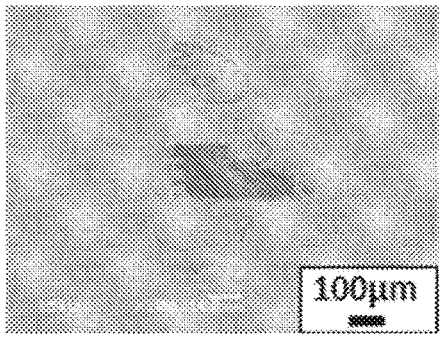

With regard to abrasion resistance, the primer layer is exposed only in Comparative Example 1 in which silver that is soft and has a property of tending to undergo adhesion is exposed at the surfaces of both contacts. In FIG. 4(*b*), a dark region observed near the center of the image is a site at which nickel of the primer metal layer is exposed. On the other hand, in Working Examples 1 and 2 and Comparative Example 2 in which the silver-tin alloy is exposed at least in one of the contacts, the primer layer is not exposed. It is confirmed in the image of FIG. 4(*a*) corresponding to Working Example 1 that the primer layer is not exposed. It is thought that such a high abrasion resistance is caused by the fact that the silver-tin alloy has a high hardness. Also, in the combination of the silver-tin alloy layer and the silver layer, the result that a high abrasion resistance can be obtained without exposure of the primer layer being observed in either Working Example 1 for which abrasion of the surface of the silver-tin alloy layer is evaluated or Working Example 2 for which abrasion of the silver layer is evaluated shows that, in the electric contacts between the silver-tin alloy layer and the silver layer, an abrasion suppression effect can be obtained in both the silver-tin alloy layer and the silver layer.

Comparative Example 2 in which the silver-tin alloy is exposed in both contacts has a very small frictional coefficient of 0.3. This is interpreted as due to the high hardness of the silver-tin alloy. On the other hand, Comparative Example 1 in which silver is exposed in both contacts has a relatively high frictional coefficient of 0.9. This is interpreted as being due to softness and ease of adhesion of silver. However, Working Example 1 in which silver is exposed in one of the contacts and the silver-tin alloy is exposed in the other contact has a higher frictional coefficient than that of Comparative Example 2. It is thought that this is the result of the surface of the silver-tin alloy having a large surface roughness being pressed against the surface of the silver layer that is soft and has a small surface roughness.

As described above, constituting an electric contact by combining a contact in which a silver-tin alloy is exposed and a contact in which silver is exposed makes it possible to achieve a high abrasion resistance and a high frictional coefficient while reducing the contact resistance to a small value to some extent. If the silver-tin alloy is exposed in both contacts, or if silver is exposed in both contacts, a high abrasion resistance or a high frictional coefficient is not achieved.

Although an embodiment of the present disclosure was described in detail above, the present disclosure is not limited in any way to the above-described embodiments, and it will be appreciated that various modifications can be made without departing from the gist of the present disclosure.

The invention claimed is:

1. An electric contact comprising:

a first contact and a second contact that are capable of forming electrical contact with each other, wherein:

the first contact has a silver-tin alloy layer exposed at an outermost surface that comes into contact with the second contact, the second contact has a silver layer exposed at an outermost surface that comes into contact with the first contact, and a surface roughness of the silver-tin alloy layer of the first contact is larger than a surface roughness of the silver layer of the second contact.

2. The electric contact according to claim 1, wherein the silver-tin alloy layer of the first contact has a surface roughness Ra of 0.5 μm or more and 2.0 μm or less.

3. The electric contact according to claim 1, wherein the first contact has a silver layer directly below the silver-tin alloy layer.

4. The electric contact according to claim 1, wherein the silver-tin alloy layer of the first contact has a hardness of 150 Hv or more.

5. The electric contact according to claim 1, wherein the silver layer of the second contact has a hardness of 50 Hv or more and 80 Hv or less.

6. The electric contact according to claim 1, wherein at least one of the first contact and the second contact has a primer metal layer made of nickel or a nickel alloy between a base material and a layer that is exposed at the outermost surface.

7. The electric contact according to claim 1, wherein the base material that forms the first contact and the second contact is made of any of copper, a copper alloy, aluminum, and an aluminum alloy.

8. The electric contact according to claim 1, wherein the first contact is a contact having a bulge shape, and wherein the second contact is a contact that has a plate shape and comes into electrical contact with an apex portion of the first contact.

9. The electric contact according to claim 1,
wherein a dynamic frictional coefficient between the first contact and the second contact is 0.4 or more.

10. The electric contact according to claim 1,
wherein a dynamic frictional coefficient between the first contact and the second contact is 0.1 or more.

11. The electric contact according to claim 1,
wherein a main phase of the silver-tin alloy layer of the first contact is a phase having a $Ag_3Sn$ composition.

12. A connector terminal pair comprising:
a pair of connector terminals that come into electrical contact with each other at a contact portion,
wherein the contact portion has the electric contact according to claim 1.

* * * * *